US009468572B2

(12) United States Patent
Schulke

(10) Patent No.: US 9,468,572 B2
(45) Date of Patent: Oct. 18, 2016

(54) ELECTRIC WHEELCHAIR WITH AN ADJUSTABLE OVERHEAD CANOPY

(71) Applicant: GOSOLARLIFE, LLC, Phoenix, AZ (US)

(72) Inventor: Glenn Schulke, Phoenix, AZ (US)

(73) Assignee: GOSOLARLIFE, LLC, Phoenix, AZ (US)

( * ) Notice: Subject to any disclaimer, the term of this patent is extended or adjusted under 35 U.S.C. 154(b) by 0 days.

(21) Appl. No.: 14/795,068

(22) Filed: Jul. 9, 2015

(65) Prior Publication Data

US 2016/0008193 A1 Jan. 14, 2016

Related U.S. Application Data

(60) Provisional application No. 62/023,009, filed on Jul. 10, 2014.

(51) Int. Cl.
*A61G 5/10* (2006.01)
*A61G 5/04* (2013.01)

(52) U.S. Cl.
CPC . *A61G 5/10* (2013.01); *A61G 5/04* (2013.01); *A61G 2005/1094* (2013.01)

(58) Field of Classification Search
CPC ..... F16M 11/26–11/30; A61G 5/00; A61G 5/04; A61G 5/10; A61G 5/1094; A61G 5/12; A45B 25/18; A45B 11/00; A45B 2023/0025; A45B 2011/005
See application file for complete search history.

(56) References Cited

U.S. PATENT DOCUMENTS 3,724,885 A * 4/1973 Becker ..... F16B 7/1427 248/188.5
9,238,861 B2 * 1/2016 Munteanu ..... H01L 21/02557
2002/0088091 A1 * 7/2002 Grote ..... B05C 17/0205 16/429
2013/0186697 A1 * 7/2013 Schneider ..... B60L 8/003 180/2.2

* cited by examiner

*Primary Examiner* — Jeffrey J Restifo
*Assistant Examiner* — Erez Gurari
(74) *Attorney, Agent, or Firm* — Polsinelli PC

(57) ABSTRACT

Various embodiments of an electric wheelchair or other type of motorized conveyance having an adjustable canopy are disclosed. The electric wheelchair includes a motorized chair coupled to the adjustable canopy with a support structure that allows an individual to manually adjust the orientation and/or configuration of the adjustable canopy. The support structure includes a tubing arrangement consisting of plurality of smaller-diameter tubes secured to a respective one of a plurality of larger-diameter tubes, which are coupled together by a collar. Each collar defines a channel configured to receive a smaller-diameter tube and a larger-diameter tube in telescopic relation to each other. In addition, each collar defines a middle portion formed between a first side portion and a second side portion that form respective first and second slots with the middle portion. The channel defines a first smaller passage in communication with a second larger passage in which the first smaller passage is configured to receive the smaller-diameter tube and the second larger passage is configured to receive the larger-diameter tube when coupling the two tubes together. In some embodiments, the adjustable canopy includes a solar panel arrangement that generates energy to charge the battery of the motorized chair and may be reoriented or reconfigured when the adjustable canopy is adjusted.

12 Claims, 9 Drawing Sheets

ELECTRIC WHEELCHAIR WITH AN ADJUSTABLE OVERHEAD CANOPY

CROSS REFERENCE TO RELATED APPLICATIONS

This is a non-provisional application that claims benefit to U.S. provisional application Ser. No. 62/023,009 filed on Jul. 10, 2014, and is herein incorporated by reference in its entirety.

FIELD

This document relates to an electric wheelchair or other motorized conveyance with an adjustable overhead canopy, and in particular to an electric wheelchair with an adjustable overhead canopy having a non-rigid or flexible-type of solar panel arrangement.

BACKGROUND

Electric-powered wheelchairs are useful for those individuals unable to propel a manual wheelchair or who may need to use a wheelchair for distances or over terrain which would be fatiguing in a manual wheelchair. Typically, an electric motor is usually powered by rechargeable deep-cycle batteries that drive a chassis for providing front, center, or rear wheel drive, and all-wheel drive. However, many such rechargeable batteries are limited to a one day charge, thereby requiring daily recharging.

Solar panel systems are well known sources of electrical power that convert sunlight into electrical energy. Recently, solar energy powered wheelchairs have been designed that rely solely on solar energy as a source of electrical energy. In these types of wheelchairs, the solar panels are arranged above the wheelchair using a fixed support structure that provides an excellent orientation for receiving sunlight as well as shade to the individual sitting in the wheelchair. However, such support structures, for example canopies, are either fixed structures with no means for adjustment or support structures with no easy and accessible means for making various types of adjustments to the canopy, especially for a user that may be handicapped and have limited mobility for adjusting the overhead canopy.

SUMMARY

In some embodiments, an electric wheelchair or other type of motorized conveyance includes a motorized chair coupled to an adjustable canopy having a support structure that allows an individual to manually adjust the orientation and/or configuration of the adjustable canopy relative to the motorized chair. The support structure includes a tubing arrangement consisting of plurality of smaller-diameter tubes secured to a respective one of a plurality of larger-diameter tubes, which are coupled together by a collar. Each collar defines a channel configured to receive a smaller-diameter tube at one end and a larger-diameter tube at the opposite end thereof in telescopic relation to each other.

In addition, each collar has a collar body defining a middle portion formed between a first side portion and a second side portion that form respective first and second tangential slots with the middle portion. The channel formed by the collar body defines a first passage in communication with a second passage in which the first passage is configured to receive the smaller-diameter tube therein and the second passage is configured to receive the larger-diameter tube therein when coupling the two tubes together using the collar. In some embodiments, the adjustable canopy includes a solar panel arrangement that generates energy to charge the battery of the motorized chair and may be reoriented or reconfigured when the adjustable canopy is adjusted by the individual using the electric wheelchair.

Additional objectives, advantages and novel features will be set forth in the description which follows or will become apparent to those skilled in the art upon examination of the drawings and detailed description which follows.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
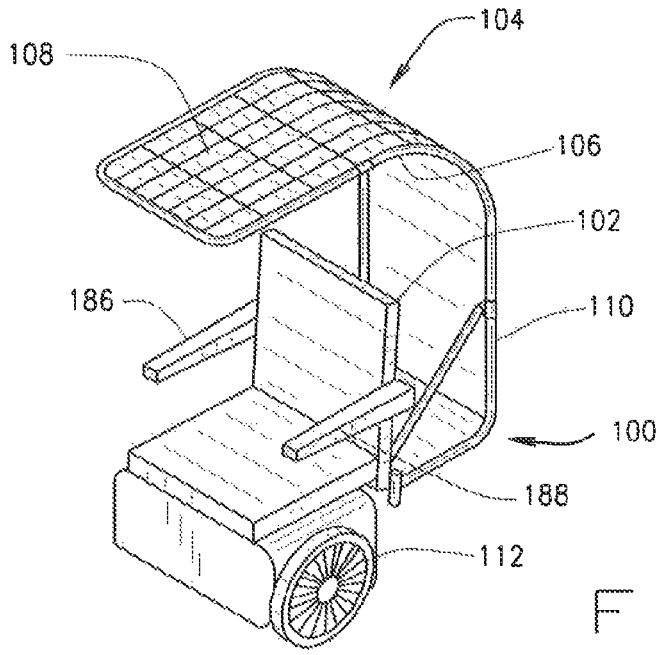
FIG. 1 is a perspective view of the electric wheelchair showing an adjustable overhead canopy attached to a motorized chair of the electric wheelchair.

Various embodiments of an electric wheelchair having an adjustable overhead canopy are disclosed. The electric wheelchair includes a motorized chair coupled to an adjustable overhead canopy with a support structure that allows an individual to manually adjust the orientation and/or configuration of the adjustable overhead canopy relative to the motorized chair. The support structure includes a tubing arrangement consisting of plurality of smaller-diameter tubes secured to a respective one of a plurality of larger-diameter tubes by the collars. Each collar defines an axial channel configured to receive a smaller-diameter tube at one end of the collar and a larger-diameter tube at the opposite end thereof in which the smaller-diameter tube is in telescopic relation relative to the larger-diameter tube. In addition, each collar defines a middle portion formed between a first side portion and a second side portion that form respective first and second tangential slots with the middle portion. The axial channel defines a first passage in communication with a second passage in which the first passage is configured to receive the smaller-diameter tube and the second passage, which has a smaller inner diameter than the second passage, is configured to receive the larger-diameter tube. In some embodiments, the adjustable overhead canopy includes a solar panel arrangement that generates energy to charge the battery of the motorized chair and may be reoriented or reconfigured when the adjustable canopy is adjusted. Referring to the drawings, an embodiment of an electric wheelchair with an adjustable canopy is illustrated and generally indicated as 100 in FIGS. 1-21.

As shown in FIGS. 1-5, embodiments of the electric wheelchair 100 include a motorized chair 102 secured to an adjustable overhead canopy 104 capable of being manually adjusted to various orientations and/or different configurations. The motorized chair 102 may include a pair of wheels 112 driven by a motor 194 (FIG. 2) and powered by a battery 192 in which a control apparatus (not shown) allows an individual to control the operation of the electric wheelchair 100. In some embodiments, the motorized chair 102 includes first and second arm portions 186 and 188 configured to act as arm rest for the individual.

Referring to FIGS. 1-7, in some embodiments, the adjustable overhead canopy 104 includes a tubing arrangement 106 that provides a support structure 110 capable of manual adjustment of the adjustable overhead canopy 104. In some embodiments, the adjustable overhead canopy 104 may include a solar panel arrangement 108 that is secured to the support structure 110 and provides a power source for energizing the battery 192 that powers the motor 194. As shown in FIGS. 1, 2, and 5-7, in some embodiments the solar panel arrangement 108 may be a plurality of thin-film solar panels on a flexible substrate that allows the solar panel arrangement 108 to substantially comport with the different configurations and/or orientations of the adjustable overhead canopy 104. For example, each of the plurality of thin-film solar panels may be a copper gallium diSelenide (CIGS) thin-film solar panel manufactured by Global Solar®. As shown in FIGS. 2, 3, 6 and 7, the adjustable overhead canopy 104 includes a canopy support portion 121 adjustably coupled between a base support portion 122 that is attached to the motorized chair 102 and a front extension portion 123 that extends over the motorized chair 102. The canopy support portion 121, base support portion 122 and front extension portion 123 are coupled together such that the adjustable overhead canopy 104 may be manually adjusted relative to each other as shall be described in greater detail below.

Figure 2:
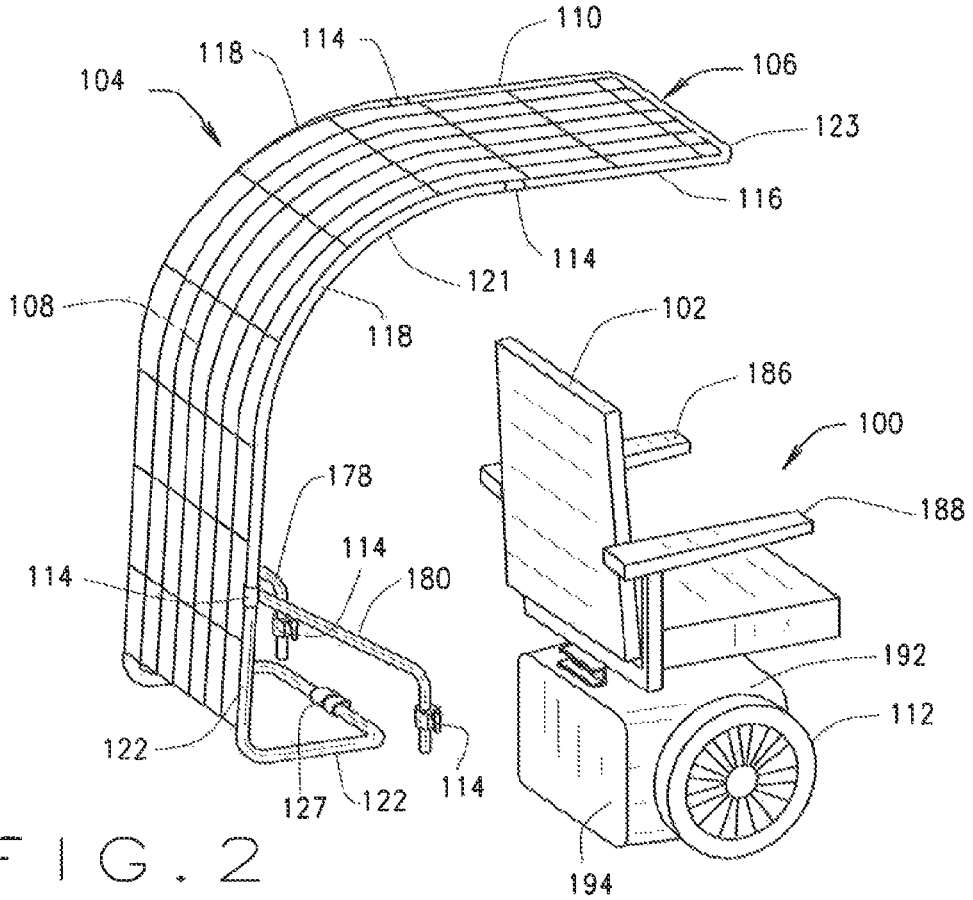
FIG. 2 is an exploded view of the electric wheelchair of FIG. 1.
Figure 3:
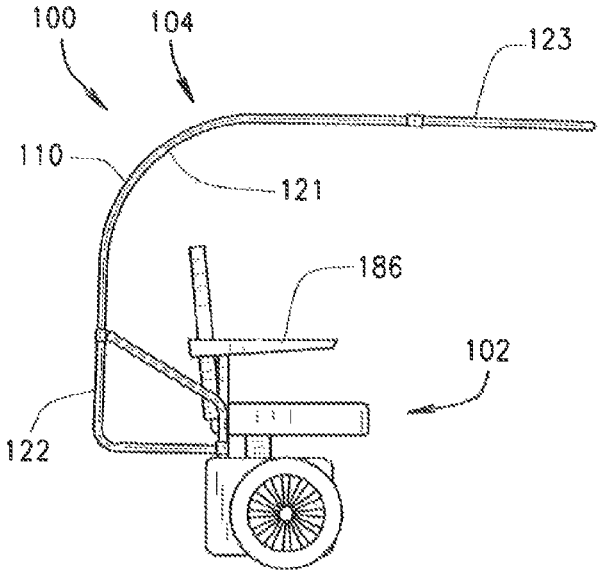
FIG. 3 is a side view of the electric wheelchair of FIG. 1.
Figure 4:
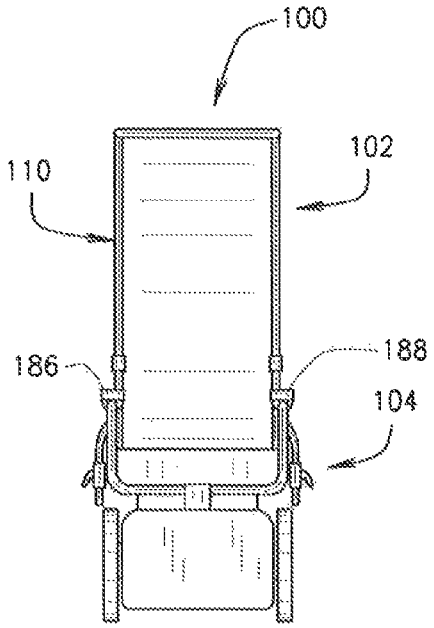
FIG. 4 is a front view of the electric wheelchair of FIG. 1.
Figure 5:
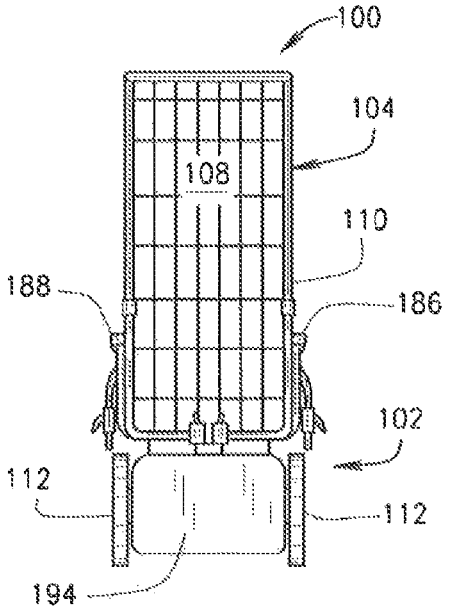
FIG. 5 is a rear view of the electric wheelchair of FIG. 1.
Figure 6:
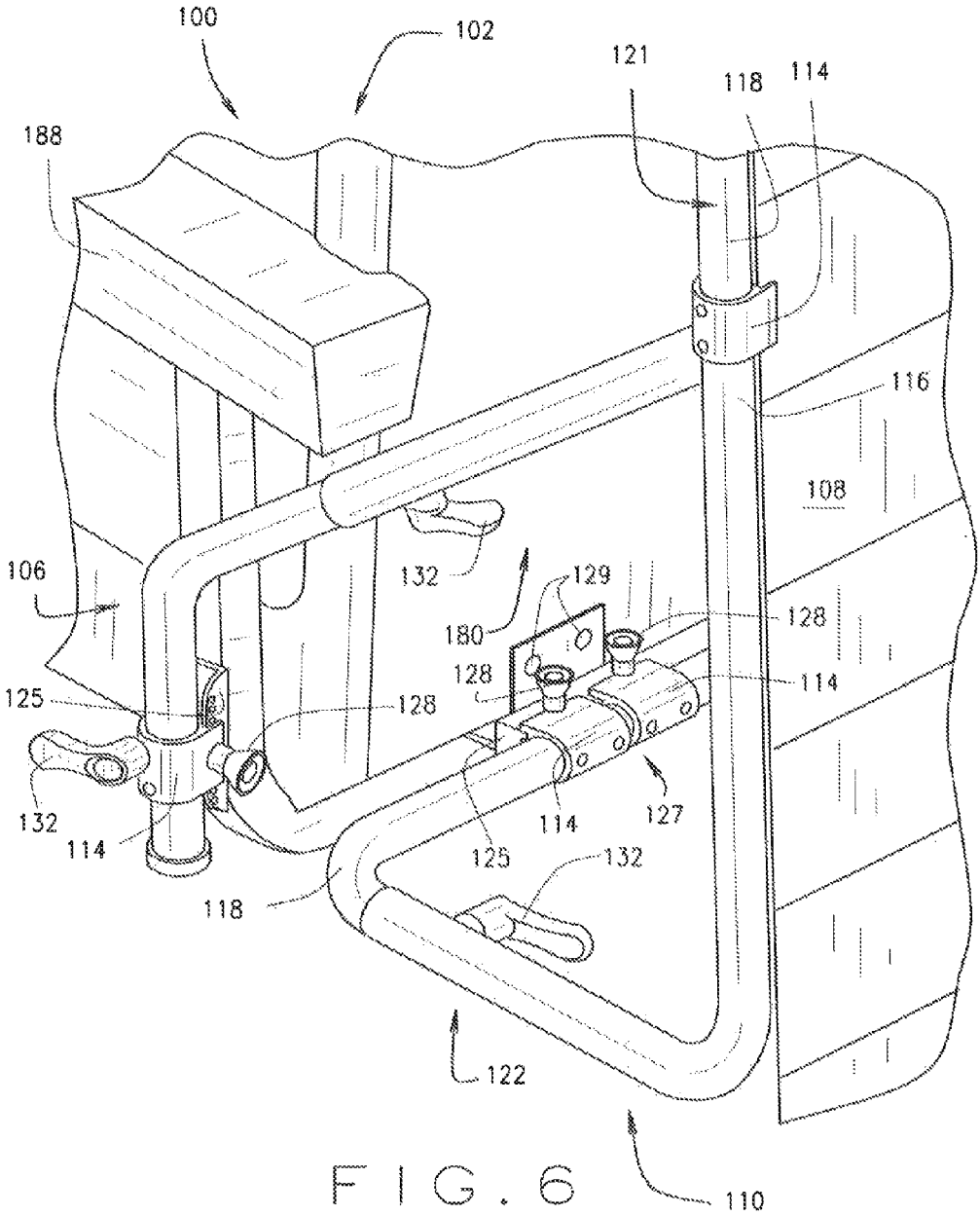
FIG. 6 is an enlarged partial view of the adjustable overhead canopy secured to one portion of the electric wheelchair using an arrangement of collars, tubes, and locking handles.
Figure 7:
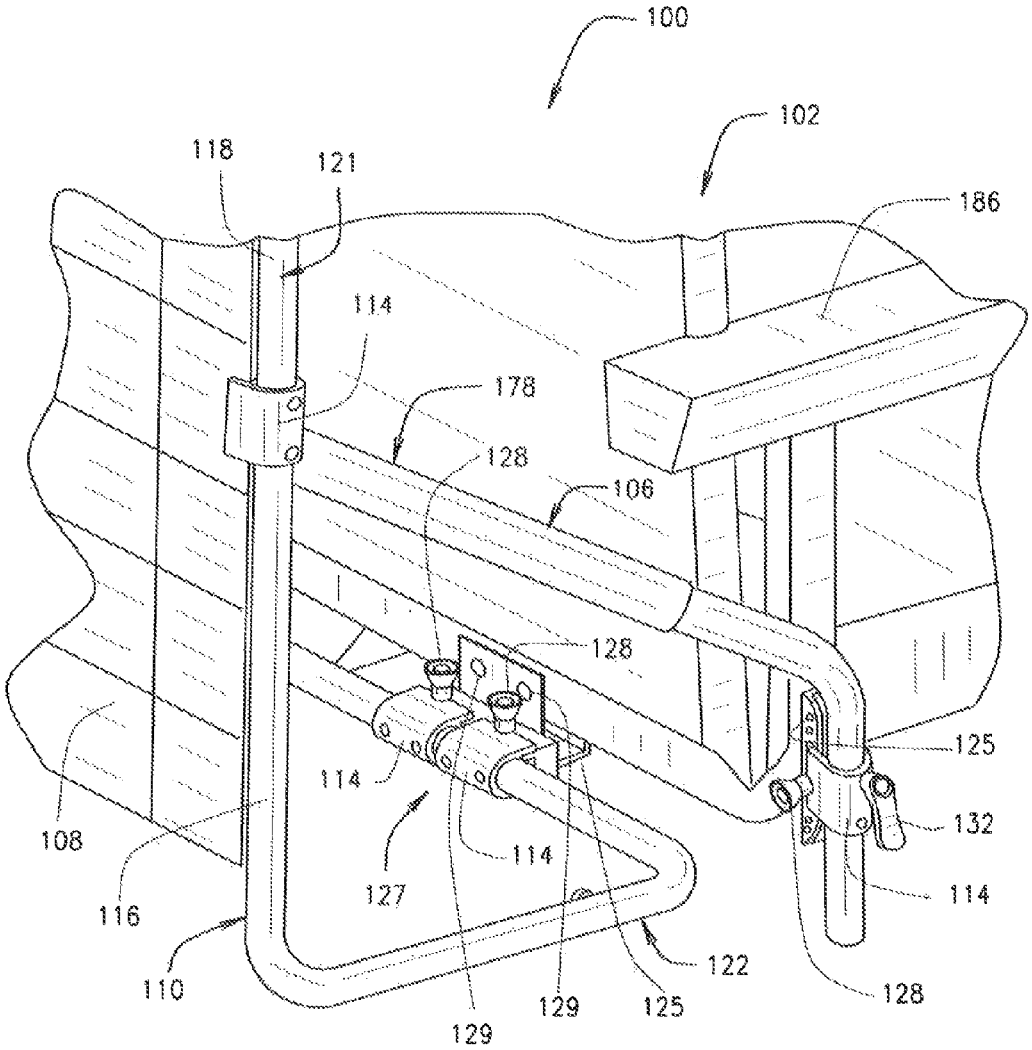
FIG. 7 is an enlarged partial view of the adjustable overhead canopy secured to another portion of the electric wheelchair using another arrangement of collars, adjustable tubing, and levers.
Figure 8:
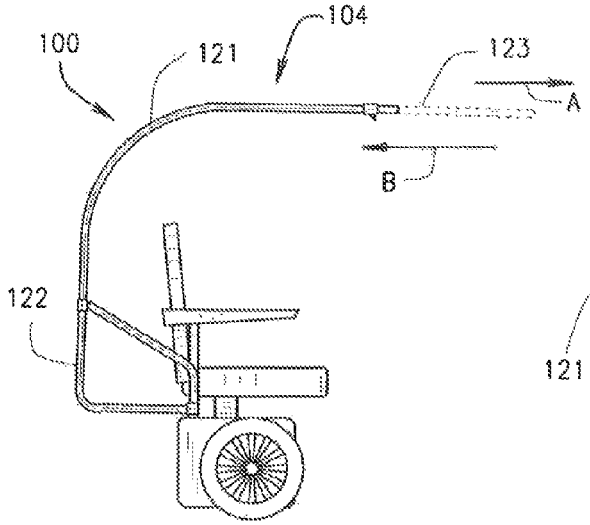
FIG. 8 is a side view of the electric wheelchair showing the adjustable overhead canopy between extended and non-extended positions.
Figure 9:
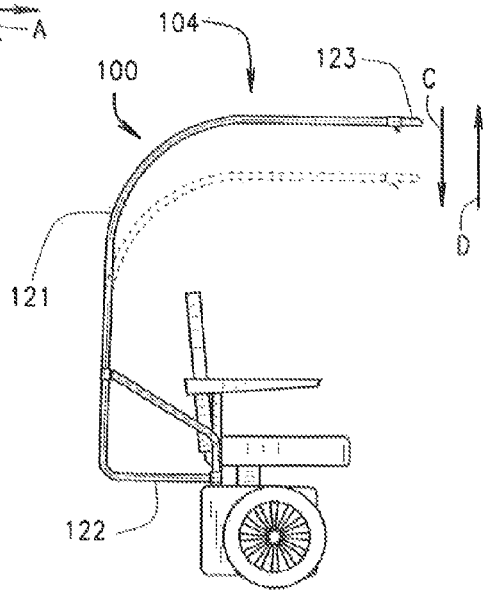
FIG. 9 is a side view of the electric wheelchair illustrating the adjustable overhead canopy between upper and lower positions.
Figure 10:
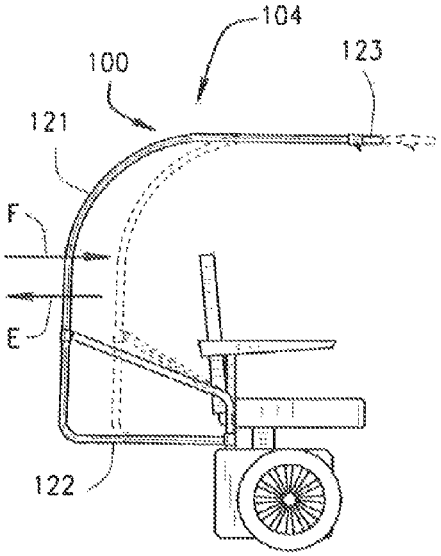
FIG. 10 is a side view of the electric wheelchair illustrating the adjustable overhead canopy between rearward and forward positions.
Figure 19:
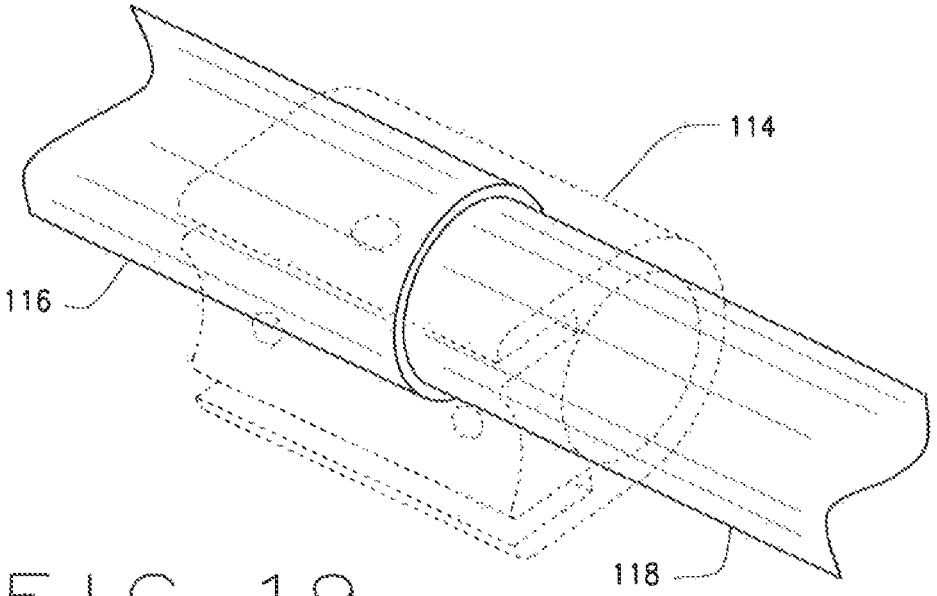
FIG. 19 is a perspective view of the larger-diameter tube coupled to smaller-diameter tube which are coupled together using the collar.

Referring to FIGS. 2, 6, and 7, the tubing arrangement 106 that forms the support structure 110 includes an assembly of smaller-diameter tubes 118 configured to be telescopically coupled within respective larger-diameter tubes 116. In some embodiments, a smaller-diameter tube 118 is coupled to a respective larger-diameter tube 116 by a collar 114. As shown in FIG. 19, each collar 114 (shown in phantom) is configured to establish a telescopic relationship between the smaller-diameter tube 118 disposed within the larger-diameter tube 116. In some embodiments, a locking handle 132 may be used to directly engage or disengage a smaller-diameter tube 118 relative to a larger-diameter tube 116 as shown in FIGS. 6 and 7.

The locking handle 132 may engage the collar 114 to either the larger-diameter tube 116 or the smaller-diameter tube 118 such that rotation of the handle 132 in one direction engages either the larger-diameter tube 116 or the smaller-diameter tube 118 to the collar 114, while rotation of the handle 132 in an opposite direction disengages either the larger-diameter tube 116 or the smaller-diameter tube 118 from the collar 114. In one aspect, disengagement of the larger-diameter tube 116 from the smaller-diameter tube 118 using the locking handle 132 allows the smaller-diameter tube 118 to slide in telescopic relation relative to the larger-diameter tube 116, thereby permitting manual adjustment of the adjustable canopy 104. Once the adjustable overhead canopy 104 has been adjusted, the locking handle 132 may then be engaged to the collar 114 to fix the new orientation and/or configuration of the support structure 110.

In one arrangement in FIGS. 2, 6 and 7, the base support portion 122 of the support structure 110 may be secured to the motorized chair 102 through a first arm portion 178 (FIG. 7) of the base support portion 122 that is attached to one side of the motorized chair 102 proximate the second arm 188 and a second arm portion 189 (FIG. 6) of the base support portion 122 that is attached to the opposite side of the motorized chair 102 proximate the first arm 186. As shown in FIG. 7, in some embodiments, the tubing arrangement 106 may also be secured to the motorized chair 102 through a collar arrangement 127 consisting of a pair of collars 114 engaged to a bracket 125 that is secured directly to the motorized chair 102 through securing members 129, such as set screws. As further shown, each of the collars 114 is secured to the bracket 125 through a respective spring-loaded pin 128 which allows each collar 114 to be secured or released to or from the base support portion 122 when the spring-loaded pins 128 are disengaged from bracket 125 and respective collar 114.

Figure 18:
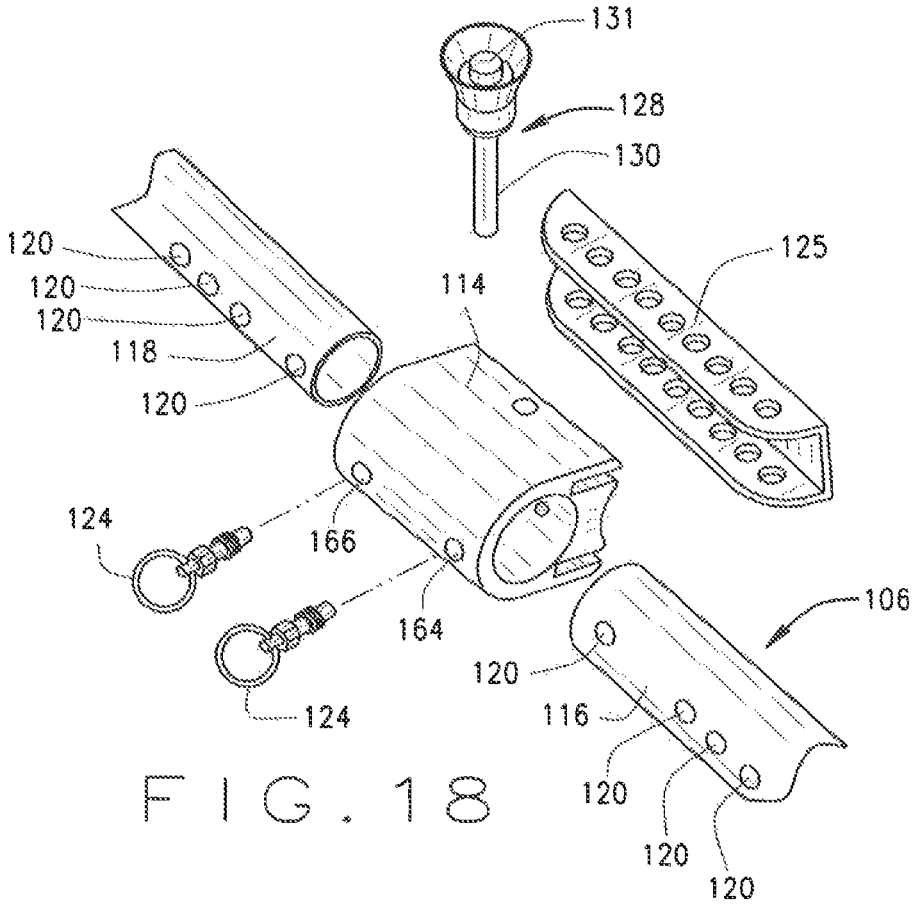
FIG. 18 is an exploded view of one bracket and collar arrangement for securing the smaller-diameter tube and the larger-diameter tube together.

Referring to FIG. 18, as noted above, the tubing arrangement 106 may be secured to the motorized chair 102 through a bracket 125 that is secured to the motorized chair 102 by a collar 114 engaged to the bracket 125 by the spring-loaded pin 128. In one embodiment, the spring-loaded pin 128 may include a pin portion 130 operatively coupled to a button 131, which is depressed by an individual to release the pin portion 130 from engagement with the collar 114 and bracket 125. In addition, in some embodiments the collar 114 may be configured to engage a pair of spring plungers 124 in which one of the spring plungers 124 secures the larger-diameter tube 116 to one portion of the collar 114 and the other spring plunger 124 secures the smaller-diameter tube 118 to another portion of the collar 114 as shall be discussed in greater detail below.

FIGS. 8-11 illustrate the various adjustments of the adjustable overhead canopy 104 for the electric wheelchair 100. In particular, the canopy support portion 121, base support portion 122 and the front extension portion 123 of the adjustable overhead canopy 104 may be manually adjusted alone or in various combinations to assume various orientations and/or configurations. In one aspect shown in FIG. 8, the front extension portion 123 may be adjusted in a frontward direction A from a non-extended position (shown in solid) to an extended position (shown in phantom) with the front extension portion 123 extending outwardly from the canopy support portion 121. Conversely, the front extension portion 123 may be adjusted in a rearward direction B from the extended position back to the non-extended position with the front extension portion 123 substantially disposed within the canopy support portion 121. In another aspect shown in FIG. 9, the canopy support portion 121 may be adjusted in a downward direction C from an upper position (shown in solid) to a lower position (shown in phantom). Conversely, the canopy support portion 121 may be adjusted in an upward direction D from the lower position back to the upper position. In yet another aspect shown in FIG. 10, the base support portion 122 may be adjusted in rearward direction E from a frontward position (shown in phantom) to a rearward position (shown in phantom). Conversely, the canopy support portion 121 may be adjusted in a frontward direction F from the rearward position back to a frontward position. In yet another aspect shown in FIG. 11, the support structure 110 may be adjusted in a tilting direction G from a non-tilted position (shown in phantom) to a tilted position (shown in solid). Conversely, the support structure 110 may be adjusted in a non-tilting direction H from the non-tilted position back to the tilted position. As noted above, the adjustment of the adjustable overhead canopy 104 may be accomplished by decoupling the larger-diameter tube 116 from the smaller-diameter tube 118 and adjust one or more of the front extension portion 123, canopy support portion 121 and base support portion 122 along directions A, B, C, D, E, F and/or G to reorient and/or reconfigure the support structure 110.

Figure 21:
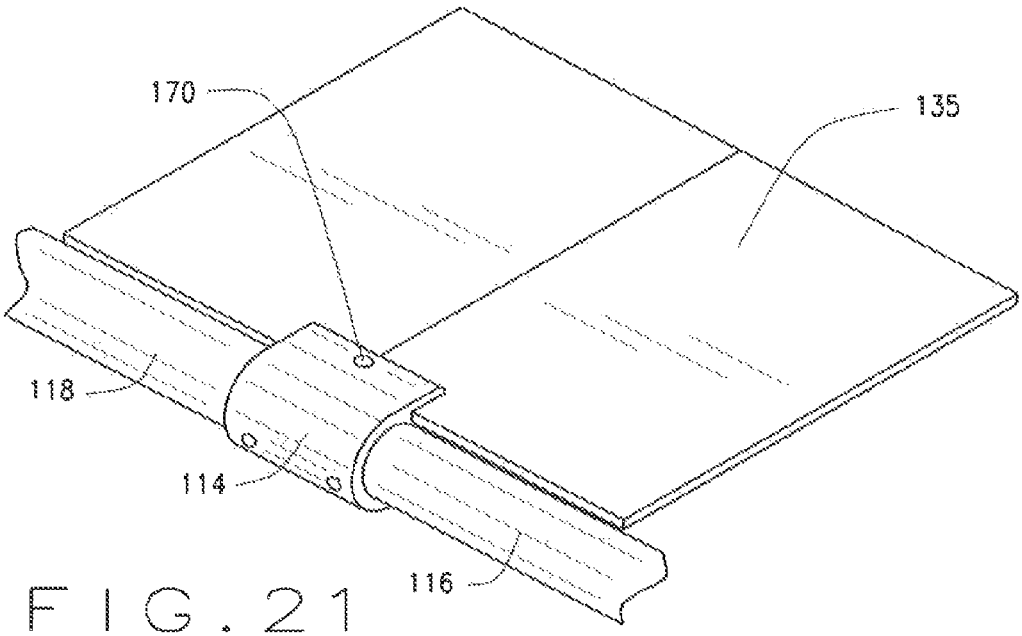
FIG. 21 is a perspective view showing the collar coupled to a plate.

Referring to FIGS. 12-17, one embodiment of the collar 114 used to couple and decouple the larger-diameter tube 116 relative to the smaller-diameter tube 118 is illustrated. As shown, the collar 114 includes a collar body 134 having a middle portion 136 formed between a first side portion 138 and a second side portion 140 which define a respective first slot 146 and a second slot 148 with the middle portion 136. In one aspect, the first slot 146 and second slot 148 extend along the entire length of the collar body 134 and are oriented in parallel relation to each other and an axis 702 and in perpendicular relation to axis 700. In some embodiments, the first and second slots 146 and 148 are configured to receive a substantially planar structure 135 (FIG. 21), such as a substantially flat backing plate or bracket, when assembling the larger-diameter tube 116 with the smaller-diameter tube 118. As shown in FIGS. 12-14, and 17, the first side portion 138 forms an aperture 170 which communicates with the first slot 146 and the second side portion 140 forms an aperture 168 which communicates with the second slot 148. The apertures 168 and 170 are configured to receive a respective securing member (not shown), such as spring plungers 124, for coupling or decoupling the planar structure 135 relative to the collar 114 as shown in FIG. 21.

Figure 17:
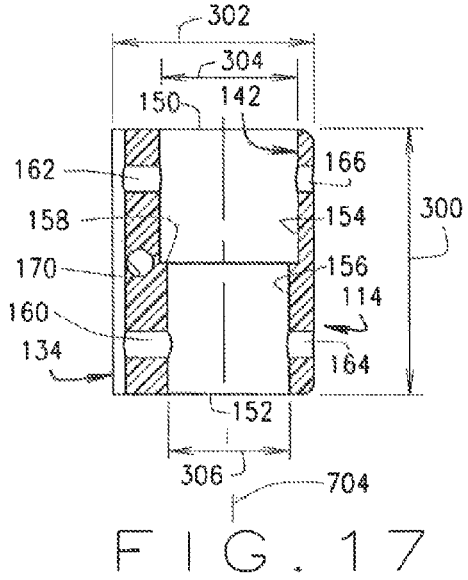
FIG. 17 is a cross-sectional view of the collar taken along line 17-17 of FIG. 16.

Referring to FIGS. 12-15 and 17, the collar 114 further defines an axial channel 142 oriented along axis 704 (FIG. 12) that communicates with a first opening 150 formed at one end of the collar body 134 and a second opening 152 formed at an opposite end of the collar body 134. As shown in FIG. 17, the channel 142 forms a first passage 154 in communication with a second passage 156 and a shoulder 158 that separates the first and second passages 154 and 156. In some embodiments, the inner diameter of the first passage 154 is less than the inner diameter of the second passage 156 such that the first passage 154 is configured to receive the larger-diameter tube 116 therein and the second passage 156 is configured to receive the smaller-diameter tube 118 therein when coupling the tubing arrangement 106 to the collar 114 as shown in FIG. 19.

Figure 12:
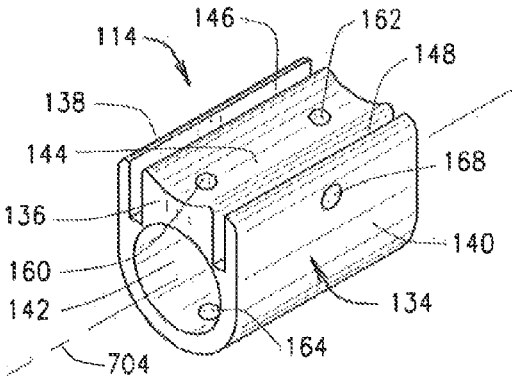
FIG. 12 is an isometric view of the collar showing the middle portion formed between first and second side portions that collectively define first and second slots and an axial channel.
Figure 13:
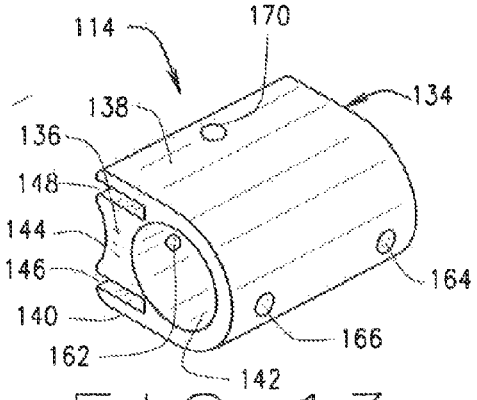
FIG. 13 is another isometric view of the collar in a different orientation relative to the collar of FIG. 12.
Figure 14:
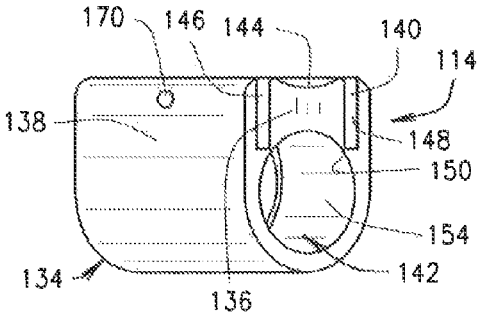
FIG. 14 is a perspective view of the collar showing a first passage defined by the channel.
Figure 20:
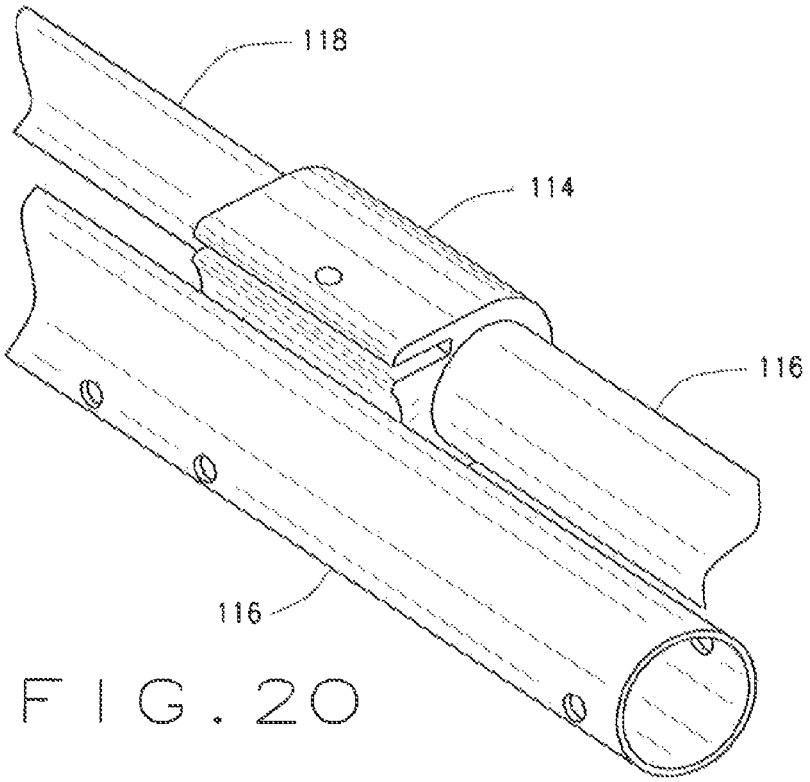
FIG. 20 is a perspective view of the collar for coupling the smaller-diameter-tube and the large-diameter tube together with another large-diameter tube engaged directly to the middle portion of the collar.

Referring to FIGS. 12-16, the middle portion 136 defines a curved outer surface 144 that is configured to comport with the general shape of either the larger-diameter tube 116 or the smaller-diameter tube 118 when engaging either tube 116 or 118 to the collar as illustrated in FIG. 20. As shown in FIGS. 12, 13 and 17, the middle portion 136 further defines apertures 160 and 162 that are aligned with apertures 164 and 166, respectively, formed on the opposite side of the collar body 134. In addition, the aligned apertures 160 and 164 communicate with the first passage 154 for allowing engagement with the larger-diameter tube 116 disposed therein, while aligned apertures 162 and 166 communicate with the second passage 156 for allowing engagement of the smaller-diameter tube 118 disposed therein. Each of the apertures 160, 162, 164 and 166 are configured to receive a respective coupling member, such as the spring plunger 124 or spring loaded pin 128, for allowing engagement and disengagement of the larger-diameter tube 116 and the smaller-diameter tube 118 from the collar 114 as illustrated in FIG. 18.

Referring to FIG. 18, both the larger-diameter tube 116 and the smaller-diameter tube 118 define a plurality of openings 120 formed in alignment along the body of each tube 116 and 118 which are each configured to receive a respective spring plunger 124 or other type of coupling member, such as the handle 132, when the larger-diameter tube 116 is telescopically disposed within the smaller-diameter tube 118 and respective openings 120 of each tube 116 and 118 are properly aligned relative to each other and respective apertures 162, 164, 166 and 168. In one arrangement, one of the openings 120 of the larger-diameter tube 116 may be disposed within the collar 114 such that the opening 120 is aligned with aperture 166 of the collar 114, while one of the openings 120 of the smaller-diameter tube 118 may be disposed within the collar 114 such that the opening 120 is aligned with aperture 164 of the collar 114. Once so aligned, a spring plunger 124 may be inserted through the aligned opening 120 and aperture 166 as well as another spring plunger 124 inserted through the aligned opening 120 and aperture 164 to couple the larger-diameter tube 116 and the smaller-diameter tube 118 within first and second passages 154 and 156, respectively, of collar 114. In other arrangements, the larger-diameter tube 116 may be coupled to the collar 114 as described above while the smaller-diameter tube 118 may be inserted into the lumen of the larger-diameter tube 116 in telescopic relation therein until one of the openings 120 of the smaller-diameter tube 118 is aligned with one of the openings 120 of the larger-diameter tube 116 to allow the tubing arrangement 106 to be adjusted.

As described above, the collar 114 provides a single versatile connection component that provides both a telescopic arrangement between coupled tubes when assembling and adjusting the adjustable overhead canopy 104, while also defining the first and second slots 146 and 148 configured to engage a bracket 125 or planar structure 135 when reorienting and/or reconfiguring different portions of the support structure 110 for the adjustable canopy 104.

Figure 11:
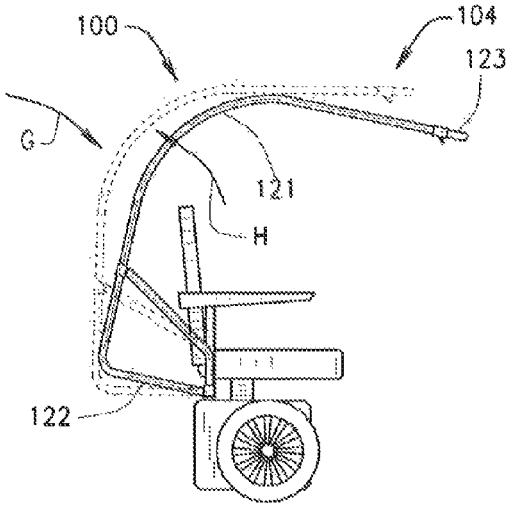
FIG. 11 is a side view of the electric wheelchair illustrating the adjustable overhead canopy between tilt and non-tilt positions.
Figure 22:
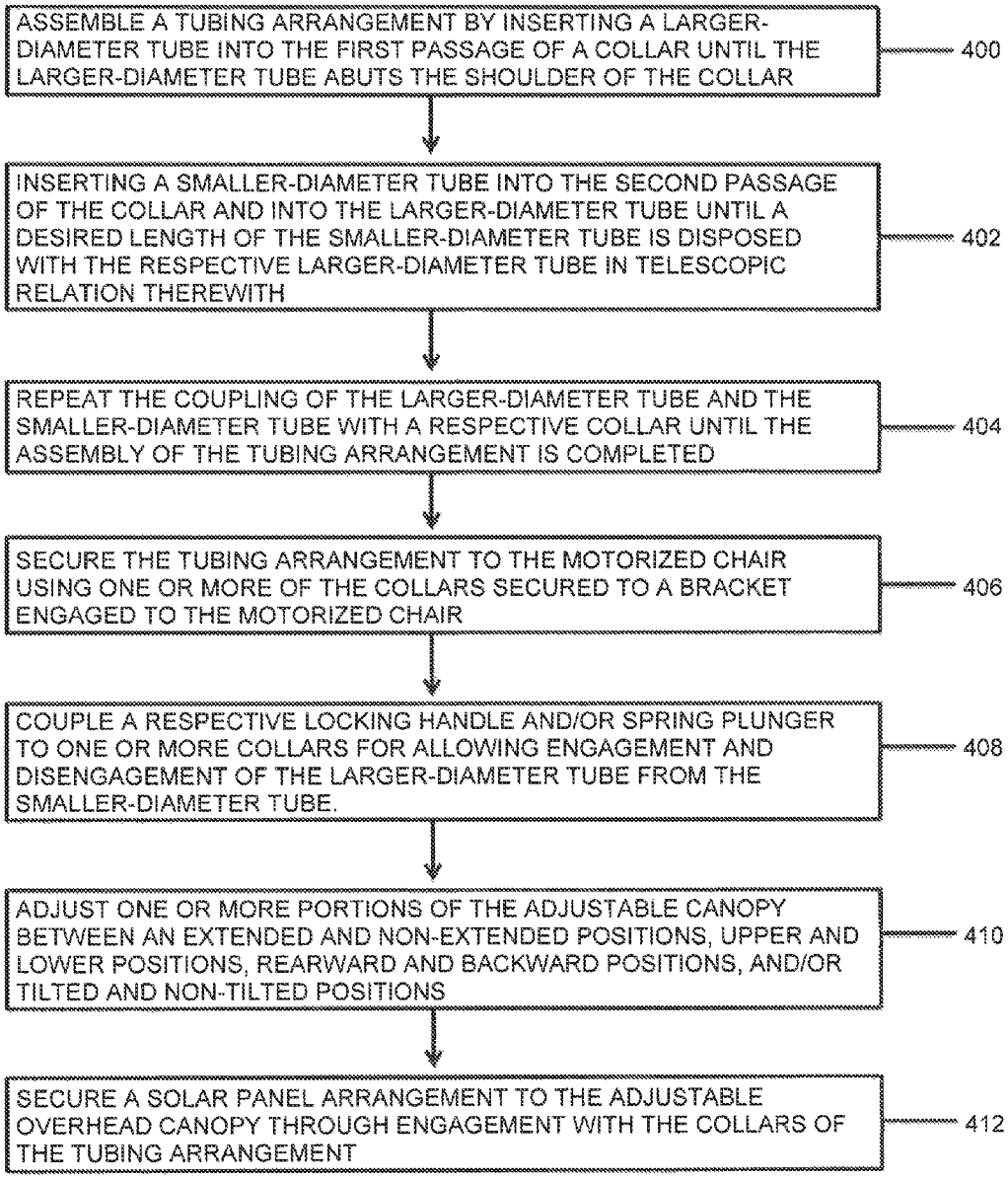
FIG. 22 is a flow chart illustrating one method for manufacturing the electric wheelchair.

One method of assembling the electric wheelchair 100 is illustrated in the flow chart of FIG. 22. At block 400, assemble a tubing arrangement 106 by inserting a larger-diameter tube 116 into the first passage 154 of a collar 114 until the larger-diameter tube 116 abuts the shoulder 158 of the collar 114. At block 402, inserting a smaller-diameter tube 118 into the second passage 156 of the collar 114 and into the larger-diameter tube 116 until a desired length of the smaller-diameter tube 118 is disposed within the respective larger-diameter tube 116 in telescopic relation therewith. At block 404, repeat the coupling of the larger-diameter tube 116 and the smaller-diameter tube 118 with a respective collar 114 until the assembly of the tubing arrangement is completed. At block 406, secure the tubing arrangement 106 to the motorized chair 102 using one or more of the collars 114 secured to a bracket 125 engaged to the motorized chair 102. At block 408, couple a respective locking handle 132 and/or spring plunger 124 to one or more collars 114 for allowing engagement and disengagement of the larger-diameter tube 116 from the smaller-diameter tube 118. At block 410, adjust one or more portions 121, 122, and 123 of the adjustable canopy 104 between an extended and non-extended positions (FIG. 8), upper and lower positions (FIG. 9), rearward and backward positions (FIG. 10) and/or tilted and non-tilted positions (FIG. 11). At block 412, secure a solar panel arrangement 108 to the adjustable overhead canopy 104 through engagement with the collars 114 of the tubing arrangement 106.

Figure 15:
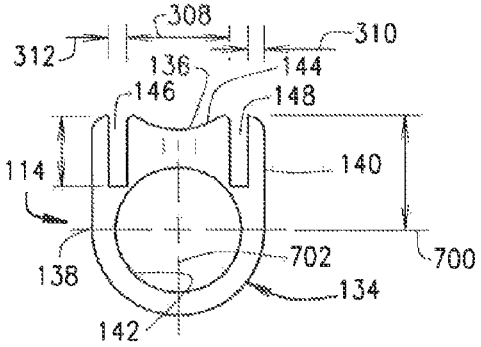
FIG. 15 is an end view of the collar of FIG. 12.
Figure 16:
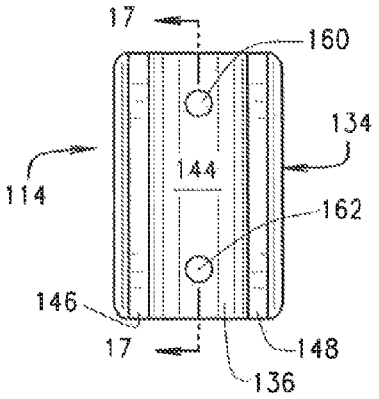
FIG. 16 is a top view of the collar of FIG. 12.

Referring to FIGS. 15 and 17, in some embodiments the collar body 134 may have the following dimensions when manufacturing the collar 114. For example, in the embodiment shown in FIG. 17, the collar body 134 may have a length 300 of about 1.30 inches and width 302 of about 1.361 inches, while the first passage 154 may have an inner diameter 304 of about 1.005 inches and the second passage 156 may have an inner diameter 306 of about 0.880 inches. As shown in FIG. 15, the middle portion 136 may have a width 308 of about 0.780 inches, while the first and second side portions 138 and 140 each have a width 310 of about 0.125 inches. As further shown, the first and second slots 146 and 148 each have a width 312 of 0.110 inches. In some embodiments, the larger-diameter tube 116 and smaller-diameter tube 118 may be made from a stainless steel material. In some embodiments, the larger-diameter tube 116 may have a diameter of about 1.00 inches, while the smaller-diameter tube 118 may have a diameter of about ⅞ inches.

As noted above, the electric wheelchair 100 may be any type of motorized conveyance, such as an electric scooter or motorcycle, having an electric source of power and configured to engage the adjustable overhead canopy 104. In some embodiments, the adjustable overhead canopy 104 provides protection from the sun, rain or snow and is sufficiently lightweight such that normal day-to-day activities performed from the electric wheelchair 100 are not interfered with nor should the adjustable overhead canopy 104 prevent the ingress or egress of the electric wheelchair 100 from standard handicap accessible doorways. In some embodiments, the adjustable overhead canopy 104 may be reoriented and/or reconfigured to maximize the exposure of the solar panel arrangement 108 to sunlight. In some embodiments, the adjustable overhead canopy 104 fits within the footprint of most electric scooters and wheelchairs.

In addition, the adjustable canopy 104 includes a universal mounting system using the arrangement of collars 114, brackets 125, spring loaded pins 128, and/or locking handles 132 to telescopically couple the larger-diameter tube 116 with the smaller-diameter tube 118 for adjustment of the adjustable overhead canopy 104 to different orientations and/or configurations.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. An electric wheelchair comprising:

a motorized chair having a pair of wheels driven by a motor powered by a battery; and an adjustable canopy having a support structure secured to the motorized chair, the support structure comprising:

a plurality of smaller-diameter tubes, each of the plurality of smaller-diameter tube telescopically disposed within a respective one of a plurality of larger-diameter tubes; and a plurality of collars, each of the plurality of collars being configured to couple a respective one of the plurality of smaller-diameter tubes within a respective one of the plurality of larger-diameter tubes in telescopic relation therewith, wherein the front extension portion is engaged to the canopy support portion in telescopic relation thereto such that the front extension portion is adjustable between a non-extended position, wherein the front extension portion is telescopically disposed within the canopy support portion and an extended position, wherein the front extension portion is telescopically extended from the canopy support portion.

2. The electric wheelchair of claim 1, wherein the support structure includes a canopy support portion coupled to a front extension portion at one end of the canopy support portion and a base support portion coupled at the opposite end thereof, wherein the base support portion is secured to the motorized chair.

3. The electric wheelchair of claim 2, wherein the base support portion is engaged to the motorized chair such that the base support portion is adjustable between a non-tilted position, wherein the canopy support portion is aligned along a first orientation and a tilted position wherein the canopy support portion is aligned along a second orientation.

4. The electric wheelchair of claim 1, wherein the plurality of larger-diameter tubes and the plurality of smaller-diameter tubes each define a plurality of openings, wherein when one of the plurality of inner-diameter tubes is telescopically disposed within a respective one of the plurality of larger-diameter tube at least one of the plurality of openings of the smaller-diameter is aligned with at least one of the plurality of openings of the larger-diameter tube.

5. An electric wheelchair comprising:

a motorized chair having a pair of wheels driven by a motor powered by a battery; and an adjustable canopy having a support structure secured to the motorized chair, the support structure comprising:

a plurality of smaller-diameter tubes, each of the plurality of smaller-diameter tube telescopically disposed within a respective one of a plurality of larger-diameter tubes; and a plurality of collars, each of the plurality of collars being configured to couple a respective one of the plurality of smaller-diameter tubes within a respective one of the plurality of larger-diameter tubes in telescopic relation therewith, wherein the canopy support portion is engaged to the base support portion in telescopic relation thereto such that the canopy support portion is adjustable between an upper position, wherein the canopy support portion is telescopically disposed within the base support portion and a lower position, wherein the canopy support portion is telescopically extended from the base support portion.

6. An electric wheelchair comprising:

a motorized chair having a pair of wheels driven by a motor powered by a battery; and an adjustable canopy having a support structure secured to the motorized chair, the support structure comprising:

a plurality of smaller-diameter tubes, each of the plurality of smaller-diameter tube telescopically disposed within a respective one of a plurality of larger-diameter tubes; and a plurality of collars, each of the plurality of collars being configured to couple a respective one of the plurality of smaller-diameter tubes within a respective one of the plurality of larger-diameter tubes in telescopic relation therewith wherein the channel is oriented along the longitudinal axis of the collar, wherein each of the plurality of collars forms a middle portion defined between a first side portion and a second side portion that collectively define a respective first and second slots with the middle portion, wherein each of the first and second slots is formed in tangential relation relative to the channel, wherein each of the first and second slots is oriented in parallel relation relative to each other.

7. The electric wheelchair of claim 6, wherein the channel defines a first passage in communication with the first opening and a second passage in communication with a second opening, wherein a shoulder is defined between the first passage and the second passage.

8. The electric wheelchair of claim 7, wherein the first passage defines a first inner diameter and the second passage defines a second inner diameter, wherein the first inner diameter is greater in diameter than the second inner diameter, and wherein the first passage is configured to receive the larger diameter tube and the second passage is configured to receive the smaller-diameter tube.

9. The electric wheelchair of claim 6, wherein each of the plurality of collars forms a first plurality of openings in communication with the channel, and wherein the plurality of larger-diameter tubes and the plurality of smaller-diameter tubes each define a second and third plurality of openings, respectively, and wherein when one of the plurality of inner-diameter tubes is engaged to the collar and telescopically disposed within a respective one of the plurality of larger-diameter tubes, at least one of the second plurality of openings of the smaller-diameter tube is aligned with at least one of the third plurality of openings of the larger-diameter tube.

10. The electric wheelchair of claim 9, wherein the first plurality of openings is in alignment with the aligned second and third plurality of openings which are aligned to each other when one of the plurality of smaller-diameter tubes is telescopically disposed within a respective one of the plurality of the larger-diameter tubes.

11. The electric wheelchair of claim 9, further comprising a plurality of locking handles, a respective one of the plurality of locking handles being configured to be received through the aligned openings of the first, second and third plurality of openings in alignment for allowing engagement and disengagement of the collar from a respective pair of the plurality of larger-diameter tubes and the plurality of smaller-diameter tubes.

12. An electric wheelchair comprising:

a motorized chair having a pair of wheels driven by a motor powered by a battery; and an adjustable canopy having a support structure secured to the motorized chair, the support structure comprising:

a plurality of smaller-diameter tubes, each of the plurality of smaller-diameter tube telescopically disposed within a respective one of a plurality of larger-diameter tubes; and a plurality of collars, each of the plurality of collars being configured to couple a respective one of the plurality of smaller-diameter tubes within a respective one of the plurality of larger-diameter tubes in telescopic relation therewith, wherein each collar defines a middle portion formed between a first side portion and a second side portion, wherein the middle portion forms an outer curved surface oriented in substantial parallel relation relative to the longitudinal axis of the channel, wherein the outer curved surface is configured to substantially comport with the shape of either the larger-diameter tube and the smaller-diameter tube.

* * * * *